US007485174B2

(12) United States Patent
Wang

(10) Patent No.: US 7,485,174 B2
(45) Date of Patent: Feb. 3, 2009

(54) ELECTROSTATIC DUST COLLECTOR

(76) Inventor: Dong-lei Wang, No. 1 Jinfeng Road, Tangjiawan Town, Xiangzhou District, Zhuhai City, Guangdong Province, 519085 (CN)

( * ) Notice: Subject to any disclaimer, the term of this patent is extended or adjusted under 35 U.S.C. 154(b) by 0 days.

(21) Appl. No.: 11/856,943

(22) Filed: Sep. 18, 2007

(65) Prior Publication Data

US 2008/0066620 A1 Mar. 20, 2008

(30) Foreign Application Priority Data

Sep. 19, 2006 (CN) ..... 2006 2 0064587 U

(51) Int. Cl.
*B03C 3/08* (2006.01)
*B03C 3/12* (2006.01)

(52) U.S. Cl. ..... 96/79; 96/88; 96/95; 96/96; 96/97; 96/98

(58) Field of Classification Search ..... 96/75–79, 96/95–100, 88
See application file for complete search history.

(56) References Cited

U.S. PATENT DOCUMENTS

| | | | | |
|---|---|---|---|---|
| 3,485,011 | A * | 12/1969 | Archer et al. | 95/81 |
| 5,573,577 | A * | 11/1996 | Joannou | 96/66 |
| 6,048,385 | A * | 4/2000 | Koide | 96/83 |
| 6,156,104 | A * | 12/2000 | Jeong | 96/88 |
| 6,251,171 | B1 * | 6/2001 | Marra et al. | 96/69 |
| 6,635,106 | B2 * | 10/2003 | Katou et al. | 96/67 |
| 6,679,940 | B1 * | 1/2004 | Oda | 96/55 |
| 6,872,238 | B1 * | 3/2005 | Truce | 95/29 |
| 7,048,780 | B2 * | 5/2006 | Kim et al. | 95/78 |
| 2006/0070526 | A1 * | 4/2006 | Hong et al. | 96/69 |
| 2006/0130658 | A1 * | 6/2006 | Chang et al. | 96/77 |

FOREIGN PATENT DOCUMENTS

| | | | | |
|---|---|---|---|---|
| GB | 2016305 A | * | 9/1979 | 96/96 |

* cited by examiner

*Primary Examiner*—Richard L Chiesa
(74) *Attorney, Agent, or Firm*—Allen, Dyer, Doppelt, Milbrath & Gilchrist, P.A.

(57) ABSTRACT

An electrostatic dust collector includes a dust charging section and a dust collecting section. The dust charging section includes: a discharge electrode which is made up of a plurality of paralleled discharge wires, and a counter-electrode which is made up of a metal honeycomb net. The dust collecting section includes: positive metal electrodes and negative metal electrodes disposed alternately, and insulating spacers disposed between each of positive metal electrode and negative metal electrode.

14 Claims, 4 Drawing Sheets

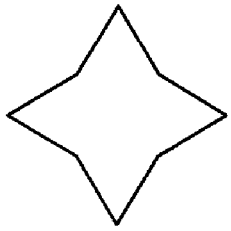
4（a）
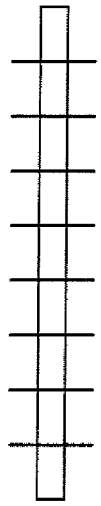
4（b）
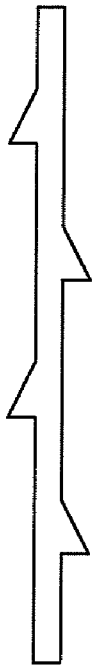
4（c）

ELECTROSTATIC DUST COLLECTOR

CROSS-REFERENCE TO RELATED APPLICATION

The present invention claims priority of CN Patent Application No. 200620064587.3 filed on Sep. 19, 2006, the contents of which are incorporated herein by reference for all purposes.

FIELD OF THE INVENTION

The present invention relates to a device for separating particles from air, especially to an electrostatic dust collector which can be applied in an air purifier or an air conditioner, etc.

BACKGROUND OF THE INVENTION

The electrostatic dust collector of prior art comprises a dust charging section and a dust collecting section, wherein said dust charging section comprises a plurality of wires applied with high voltage and a counter-electrode which is made up of paralleled wires or plates, and said dust collecting section comprises positive electrodes and negative electrodes disposed alternately. Ionizing air in dust charging section so that dust particles in the air are charged, then the charged dust particles are attracted onto corresponding electrodes by the electric field force in the dust collecting section; as a result, dust particles are separated from the air. By electrostatic dust collecting technology, the force for separating dust particles directly works on the dust particles themselves, therefore, compared with filter dust collectors or other types of dust collectors, electrostatic dust collectors are more widely applicable to different sizes of dust particles from the largest scores of microns to the smallest 0.001 microns with the lowest power consumption and the minimum air flow resistance.

However, the efficiencies of prior art electrostatic dust collectors are generally low, particular to tiny dust particles, due to the following reasons: the ionizing voltage applied in dust charging section can not be too high because of the limit by corona current, otherwise the ozone concentration is likely to exceed standards, thus the applied voltage in dust charging section is relatively low, and dust particles are not charged sufficiently; the electric field intensity between metal electrodes is limited in consideration of air breakdown or disruptive discharge, thus Coulomb forces by charged electrodes on tiny dust particles are weak, and dust particles are not easily attracted onto the corresponding electrodes with limited air flow strength.

SUMMARY OF THE INVENTION

The present invention is aimed at solving the problem of low dust removal efficiency of prior art electrostatic dust collector by providing a high efficiency electrostatic dust collector.

The object of the present invention is achieved by the following technical scheme:

An electrostatic dust collector comprises:

a dust charging section, comprising a discharge electrode which is made up of a plurality of paralleled discharge wires, and a counter-electrode which is made up of a metal honeycomb net; and the plane formed by paralleled discharge wires is parallel to the metal honeycomb net; and a dust collecting section, comprising positive metal electrodes and negative metal electrodes disposed alternately, and insulating spacers disposed between each of positive metal electrode and negative metal electrode.

Said metal honeycomb net is made of malleable metals, such as aluminum or copper; and aluminum is preferred.

Because the dust discharging section of the electrostatic dust collector of the present invention employs a plurality of paralleled discharge wires as the discharge electrode and a metal honeycomb net as the counter-electrode, higher voltage can be applied in dust discharging section; as a result, strong corona is formed in dust discharging section between the thin aluminum foil and tungsten wire which results in the emergence of stronger ion flow so as to speed up the movement of charged dust particles to be collected. Electrodes are arranged in rational structure which enables ionized ions to be distributed evenly in the air so that dust particles are more heavily charged and harmful gases are more completely decomposed. Because there are insulating spacers disposed between positive and negative metal electrodes in the dust collecting section, high electric field intensity can be formed between the positive and negative metal electrodes by applying high voltage thereon under the precondition of no air breakdown or disruptive discharge, so that dust particles are more heavily charged. In addition, because the insulating spacers are electric polarized in the strong electric field, the insulating spacers also work as the metal electrodes to collect dust particles, as a result, the dust collecting area is enlarged and dust particles are removed in higher efficiency. The present invention has a simple structure and a low production cost.

BRIEF DESCRIPTION OF THE DRAWINGS

FIG. 4(*a*)-(*c*) show cross-sectional views of different types of discharge wires in discharging section as shown in FIG. 2; wherein FIG. 4(*a*) shows a cross-sectional view of a star-type wire, FIG. 4(*b*) shows a cross-sectional view of a fishbone-type wire, and FIG. 4(*c*) shows a cross-sectional view of a bur-type wire;

DETAIL DESCRIPTION OF THE PREFERRED EMBODIMENTS

Figure 1:
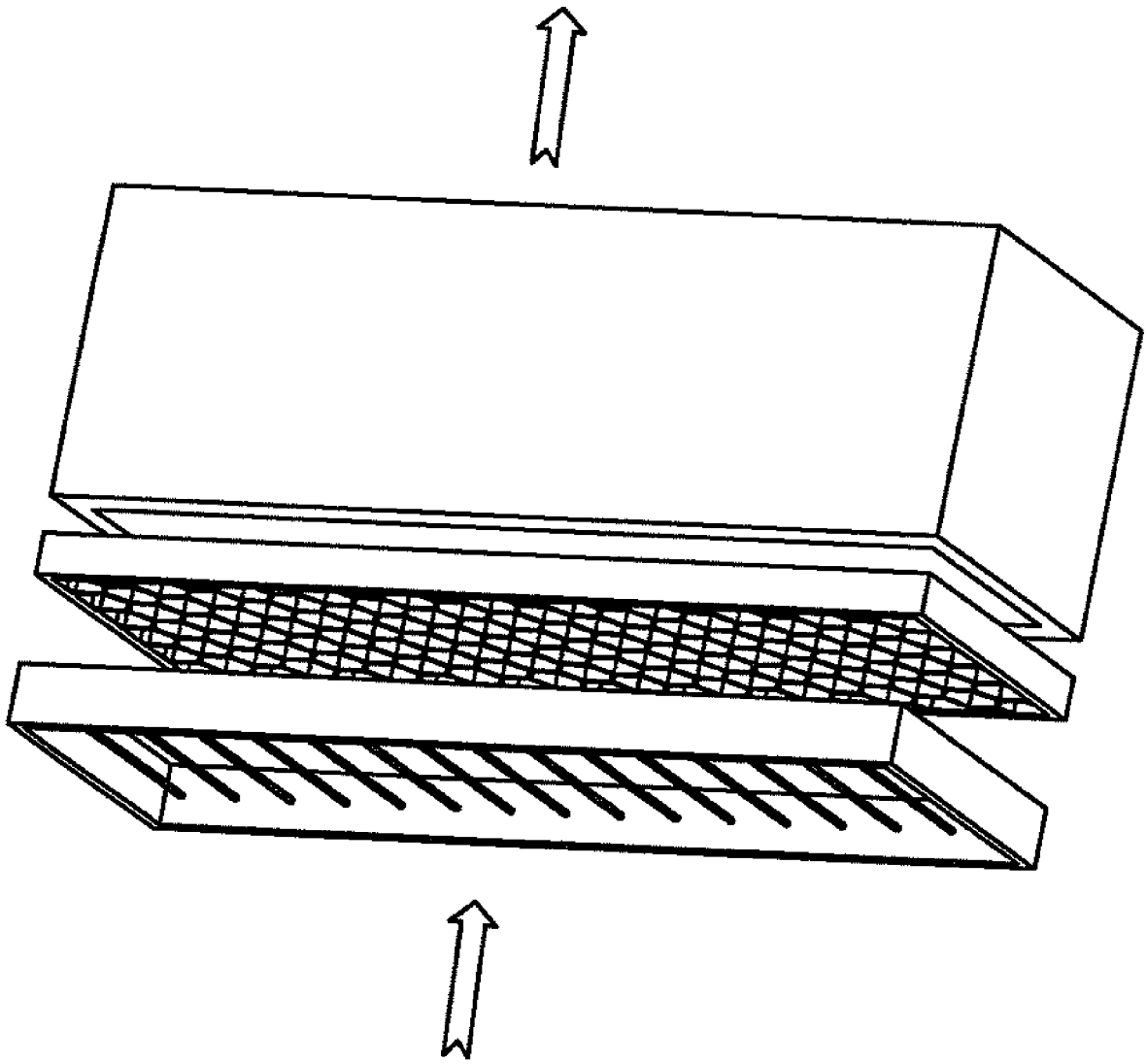
FIG. 1 is a schematic view of the electrostatic dust collector according to one embodiment of the present invention.

FIG. 1 shows one embodiment of the present invention applied in an air purifier, wherein said electrostatic dust collector comprises a dust charging section and a dust collecting section. And air flows vertically to said dust charging section and dust collecting section.

Figure 2:
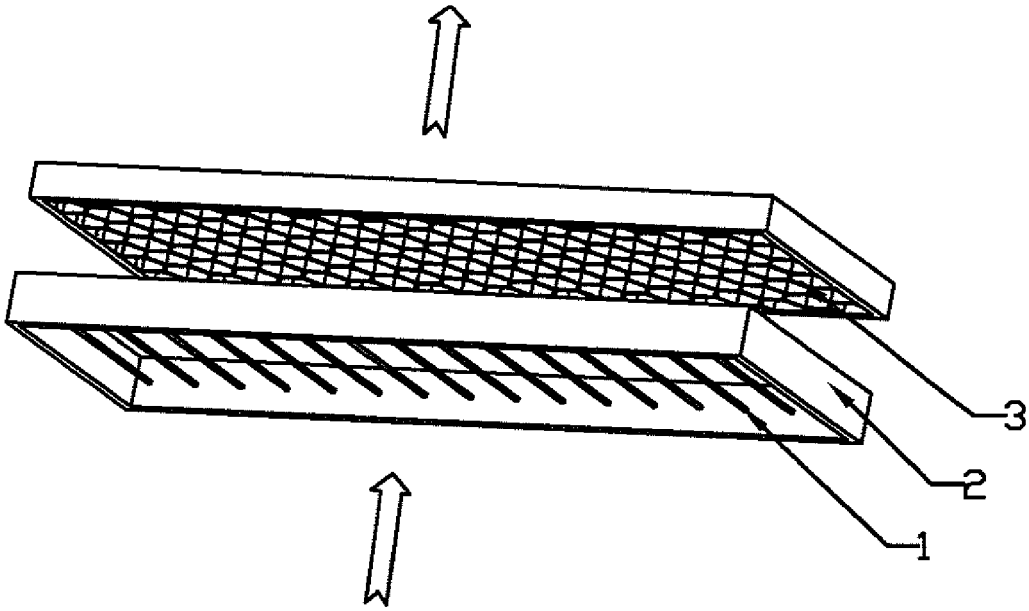
FIG. 2 is a perspective view of the dust discharging section of the electrostatic dust collector as shown in FIG. 1.
Figure 3:
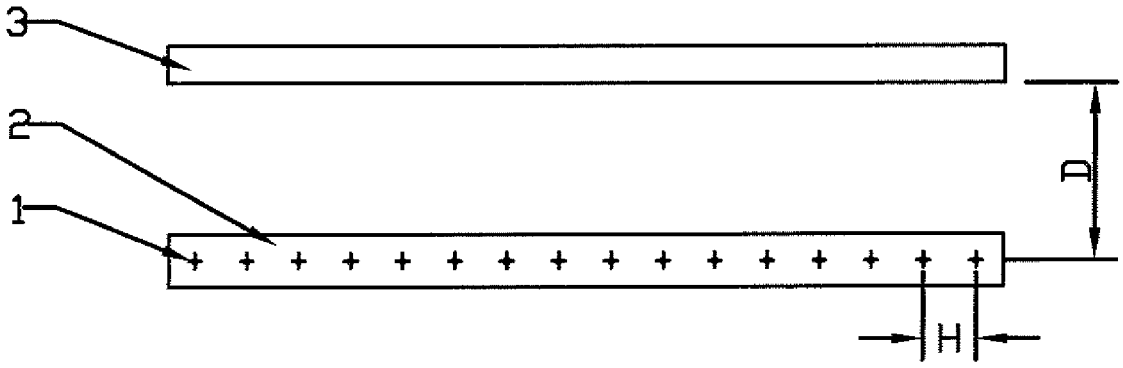
FIG. 3 is a front top view of the dust charging section as shown in FIG. 2; wherein D represents the width of discharge passage and H represents the distance between discharge wires.

As shown in FIGS. 2 and 3, said dust charging section comprises: a plurality of tungsten discharge wires 1 which are disposed on an insulating planar frame 2, and a counter-electrode made up of an aluminum honeycomb net 3. Tungsten discharge wires 1 are paralleled disposed at an equal distance, and the plane formed by tungsten discharge wires 1 is parallel to the aluminum honeycomb net 3. The ratio of the distance H between tungsten discharge wires 1 to the discharge passage width D (the distance between the tungsten discharge wires and the aluminum honeycomb net) is in the range of H=(0.8~1.2) D. The corona voltage applied between the tungsten discharge wires 1 and the aluminum honeycomb net 3 is above or equivalent to 8KVDC, with positive corona preferred, that is, said tungsten wires are electrically positive and said aluminum honeycomb net is electrically negative.

Said tungsten discharge wires can be replaced by other metal wires, and the metal wires can be straight wires or other types of wires, such as star-type wires shown in FIG. 4(*a*), fishbone-type wires shown in FIG. 4(*b*), and bur-type wires shown in FIG. 4(*c*).

Figure 5:
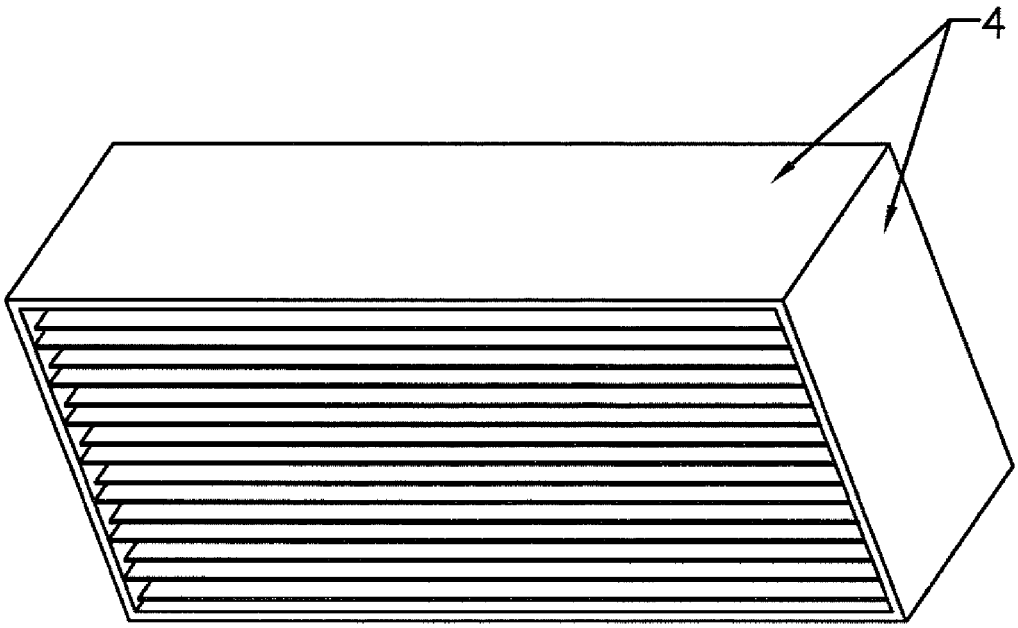
FIG. 5 is a perspective view of the dust collecting section of the electrostatic dust collector as shown in FIG. 1.
Figure 6:
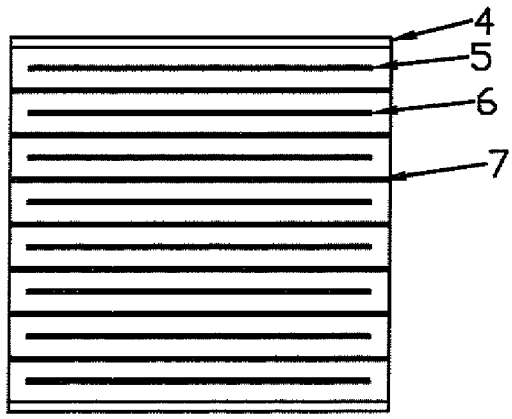
FIG. 6 is a cross-sectional view of the dust collecting section as shown in FIG. 5.

As shown in FIGS. 5 and 6, said dust collecting section comprises positive metal electrodes 5 and negative metal electrodes 6 disposed alternately, and insulating spacers 7 disposed between adjacent positive metal electrode and negative metal electrode. Said positive electrodes 5 are connected to the anode of a high DC power after they are inter-connected, and said negative electrodes 6 are connected to the cathode of a high DC power after they are inter-connected. Said positive metal electrodes 5, negative metal electrodes 6 and insulating spacers 7 are either fixed on the plastic frame 4 or made combinable and detachable with respect to said plastic frame 4. The corona voltage applied between adjacent positive and negative metal electrodes in the dust collecting section is above or equivalent to 8KVDC.

Said insulating planar frame 2, plastic frame 4 and insulating spacers 7 are made of plastic material; and said plastic material is selected from the group consisting of ABS, PP, PC, PE, PS, PVC, PBT and any other anti-electrostatic plastic materials.

The dust charging section and dust collecting section of said electrostatic dust collector are supplied by high DC powers with the same or different voltages respectively in order to have their technical parameters matched so as to purify the air as much as possible.

The electrostatic dust collector of the present invention can work in single with one set or work in parallel with multiple sets.

What is claimed is:

1. An electrostatic dust collector comprises:

a dust charging section, comprising a discharge electrode which is made up of a plurality of paralleled discharge wires, and a counter-electrode which is made up of a metal honeycomb net; and the plane formed by paralleled discharge wires is parallel to the metal honeycomb net, and a dust collecting section, comprising positive metal electrodes and negative metal electrodes disposed alternately, and insulating spacers disposed between each of positive metal electrode and negative metal electrode.

2. The electrostatic dust collector according to claim 1, wherein said discharge wires are selected from the group consisting of star-shaped wires, fishbone-shaped wires, bur-shaped wires and straight wires.

3. The electrostatic dust collector according to claim 1, wherein said discharge wires in said dust charging section are tungsten wires and said metal honeycomb net is an aluminum honeycomb net.

4. The electrostatic dust collector according to claim 3, wherein said discharge wires are positioned at the same distance interval, and the ratio H/D of the distance H between tungsten discharge wires to the discharge passage width D is in the range of 0.8~1.2.

5. The electrostatic dust collector according to claim 3, wherein said corona voltage applied between the tungsten discharge wires and the aluminum honeycomb net in the dust charging section is above or equivalent to 8KVDC.

6. The electrostatic dust collector according to claim 3, wherein said tungsten wires are electrically positive and said aluminum honeycomb net is electrically negative.

7. The electrostatic dust collector according to claim 1, wherein said corona voltage applied between adjacent positive and negative metal electrodes in the dust collecting section is above or equivalent to 8KVDC.

8. The electrostatic dust collector according to claim 1, wherein said positive metal electrodes and/or negative metal electrodes and/or insulating spacers are either fixed on a plastic frame or made combinable and detachable with respect to said plastic frame.

9. The electrostatic dust collector according to claim 8, wherein said insulating planar frame and/or plastic frame and/or insulating spacers are made of plastic material.

10. The electrostatic dust collector of according to claim 9, wherein said plastic material is selected from the group consisting of ABS, PP, PC, PE, PS, PVC, PBT and any other anti-electrostatic plastic materials.

11. The electrostatic dust collector according to claim 3, wherein said corona voltage applied between adjacent positive and negative metal electrodes in the dust collecting section is above or equivalent to 8KVDC.

12. The electrostatic dust collector according to claim 3, wherein said positive metal electrodes and/or negative metal electrodes and/or insulating spacers are either fixed on a plastic frame or made combinable and detachable with respect to said plastic frame.

13. The electrostatic dust collector according to claim 12, wherein said insulating planar frame and/or plastic frame and/or insulating spacers are made of plastic material.

14. The electrostatic dust collector according to claim 13, wherein said plastic material is selected from the group consisting of ABS, PP, PC, PE, PS, PVC, PBT and any other anti-electrostatic plastic materials.

* * * * *